US007263809B2

(12) United States Patent
Wegman

(10) Patent No.: US 7,263,809 B2
(45) Date of Patent: Sep. 4, 2007

(54) SHINGLE, IN PARTICULAR ROOF SHINGLE

(75) Inventor: Thomas Wegman, Dahn (DE)

(73) Assignee: SLS Kunstsoffverarbeitung GmbH & Co. KG, Dahn (DE)

( * ) Notice: Subject to any disclaimer, the term of this patent is extended or adjusted under 35 U.S.C. 154(b) by 206 days.

(21) Appl. No.: 10/757,691

(22) Filed: Jan. 14, 2004

(65) Prior Publication Data

US 2004/0216417 A1 Nov. 4, 2004

(30) Foreign Application Priority Data

Jan. 15, 2003 (DE) ..... 203 00 543 U

(51) Int. Cl.
*E04D 1/00* (2006.01)

(52) U.S. Cl. ..... 52/542; 52/523

(58) Field of Classification Search ..... 52/518, 52/519, 542, 554, 525, 526, 523
See application file for complete search history.

(56) References Cited

U.S. PATENT DOCUMENTS

| | | | | | |
|---|---|---|---|---|---|
| 430,364 | A * | 6/1890 | Babcock | 52/542 |
| 467,791 | A * | 1/1892 | Edwards | 52/542 |
| 912,057 | A * | 2/1909 | Auger | 52/552 |
| 1,004,338 | A * | 9/1911 | Austin | 52/550 |
| 1,567,946 | A * | 12/1925 | Helflinger | 52/546 |
| 1,888,055 | A * | 11/1932 | Tobin et al. | 52/519 |
| 1,911,141 | A * | 5/1933 | Fischer | 52/542 |
| 2,035,369 | A * | 3/1936 | Harshberger | 52/526 |
| 2,266,376 | A * | 12/1941 | Miller | 52/523 |
| 2,607,304 | A * | 8/1952 | Killingsworth | 52/527 |
| 3,866,378 | A * | 2/1975 | Kessler | 52/519 |
| 4,163,351 | A * | 8/1979 | Ishikawa | 52/542 |
| 5,615,527 | A * | 4/1997 | Attley | 52/535 |
| 6,336,303 | B1 * | 1/2002 | Vandeman et al. | 52/520 |

* cited by examiner

*Primary Examiner*—Janet M. Wilkens
(74) *Attorney, Agent, or Firm*—Horst M. Kasper

(57) ABSTRACT

A shingle includes a shingle neck, and a shingle body. A raised engagement and guide element (5) is disposed at the bottom side of the region of the shingle body (2) disposed remote relative to the shingle neck. The raised engagement and guide element (5) exhibits a raised engagement guide element (5) in the lower region of the shingle body (2). The raised engagement and guide element (5) exhibits a female mold like undercut zone (6) in the direction of the body (2) and disposed remote from the shingle neck. Correspondingly dimensioned male mold like undercut zones (7) are disposed at the two shingle shoulders (4). The width of the two shingle shoulders (4) corresponds in each case to about one half of the width of the raised engagement and guide element (5). Preferably, the shingle is a roof shingle.

24 Claims, 3 Drawing Sheets

A-A

B-B

SHINGLE, IN PARTICULAR ROOF SHINGLE

BACKGROUND OF THE INVENTION

1. Field of the Invention

The subject matter of the present Invention is a shingle, in particular roof shingle, wherein the shingle is characterized relative to the state-of-the-art in that both the laying speed as well as the placing precision are jump-like improved.

SUMMARY OF THE INVENTION

2. Brief Descriptions of the Invention

The shingle according to the present Invention, in particular the roof shingle, is characterized in that the shingle exhibits a raised engagement and guiding element at its bottom side. According to a preferred embodiment both the raised guide element as well as the so-called shingle shoulder exhibit undercut zones, wherein the undercut zones correspond to each other. Here the undercut zone in the raised engagement and guide element is formed like a female mold or stencil and the undercut zone in the shingle shoulder is formed like a male mold.

Shingles, in particular roof shingles, can be produced out of a variety of materials, for example out of mineral material, out of wood and more recently in a preferred degree out of a molten mixture of organic material, for example plastics and inorganic material, for example slate flour.

The shingle neck defines an axial direction.

A first shingle shoulder is disposed on a first side between the shingle neck and the shingle body. A first ridge forms a top side of the first shoulder.

A second shingle shoulder is disposed on a second side between the shingle neck and the shingle body. A second ridge forms a top side of the second shoulder. A raised engagement and guide element is disposed on an inner side of the shingle body and in a lower region of the shingle body and disposed remote from the shingle neck and forms a ledge. The inner side of the shingle defines a first plane. An outer side of the shingle defines a second plane disposed parallel to the first plane. The shingle neck defines an axial direction. A plurality of sectional planes is disposed perpendicular to the first plane and contain a straight line disposed parallel to the axial direction of the neck. An inner side of the raised engagement and guide element defines a third plane disposed parallel to the first plane. The ledge forms a third acute angle with the third plane when intersected by one of the plurality of sectional planes. The ledge forms a third obtuse angle with the first plane when intersected by one of the plurality of sectional planes.

The first ridge forms a first acute angle with the second plane when intersected by one of the plurality of sectional planes and the first ridge forms a first obtuse angle with the first plane when intersected by one of the plurality of sectional planes. The second ridge forms a second acute angle with the second plane when intersected by one of the plurality of sectional planes and the second ridge forms a second obtuse angle with the first plane when intersected by one of the plurality of sectional planes.

The first acute angle is from about 40 to 50 degrees. The second acute angle is from about 40 to 50 degrees. The third acute angle is from about 40 to 50 degrees. The first obtuse angle is from about 130 to 140 degrees. The second obtuse angle is from about 130 to 140 degrees. The third obtuse angle is from about 130 to 140 degrees.

The shingle comprises essentially the shingle body, the shingle neck and the shingle shoulder as will be explained and illustrated in detail further down by way of drawings.

The shingle can further exhibit gutter canals on the upper side of the shingle neck as is known in principle.

The shingle is suitable for covering arbitrary surfaces, in particular roof surfaces.

As already recited above, the laying technology can be improved in multiple directions and jump-like upon application of the invention shingles, wherein during laying each shingle assures simultaneously the restraint and restricted guidance of a shingle placed in the following. In addition, the desired positioning is necessarily obtained during laying and the necessary double covering is assured. The essence of the present Invention is explained in detail in the following by way of the accompanying figures, wherein these figures represent preferred embodiments of the present invention.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention.

DESCRIPTION OF INVENTION AND PREFERRED EMBODIMENT

Figure 1:
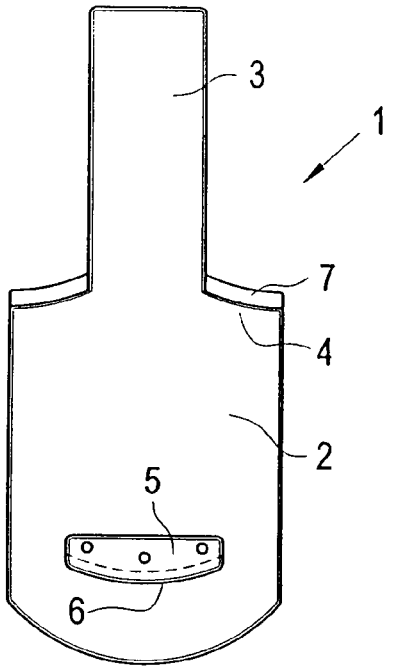
FIG. 1 shows the bottom side of the Invention shingle.
Figure 1A:
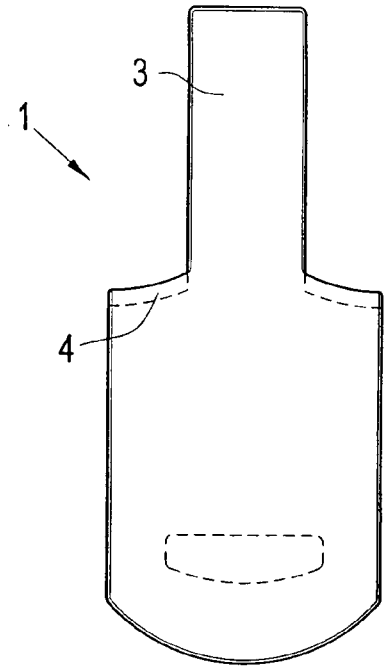

The invention shingle is designated with the reference numeral 1 in FIG. 1, the shingle body is designated with the reference numeral 2, the shingle neck is designated with the reference numeral 3, and the shingle shoulder is designated with the reference numeral 4.

The raised engagement and guide element disposed preferably in the lower region of the shingle body carries the reference numeral 5 with the female mold like undercut zone 6.

The male mold like undercut zone of the shingle shoulder 4 carries the reference numeral 7.

Here the female mold like undercut zone 6 is a rear undercut with re-entrant angle, which female mold like undercut zone 6 serves for receiving the male like undercut zone 7 of the shoulder 4, wherein the male mold like undercut zone 7 is formed nearly sharp edged.

The side 4 is situated in an angle of from about 40 to 50 degrees relative to side 2.

The male mold like undercut zone 7 of the shoulder 4 is situated in an angle of from about 40 to 50 degrees relative to a face of the shingle body 2. The female mold like undercut zone 6 is disposed perpendicular to the face of the raised engagement and guide element 5. Alternatively, the female mold like undercut zone 6 is disposed at an angle of from about 40 to 50 degrees to the face of the raised engagement and guide element 5 such a to shape match the male mold like undercut zone 7.

The geometric kind of the undercut zones 6 and 7 is furnished such at any rate that a slipping in of the male mold like undercut zone 7 into the female mold like undercut zone 6 is performed as complete as possible.

Here the width of the shoulder 4 is preferably dimensioned such that the width of the shoulder 4 corresponds to half the width of the raised engagement and guide element 5.

Figure 2:
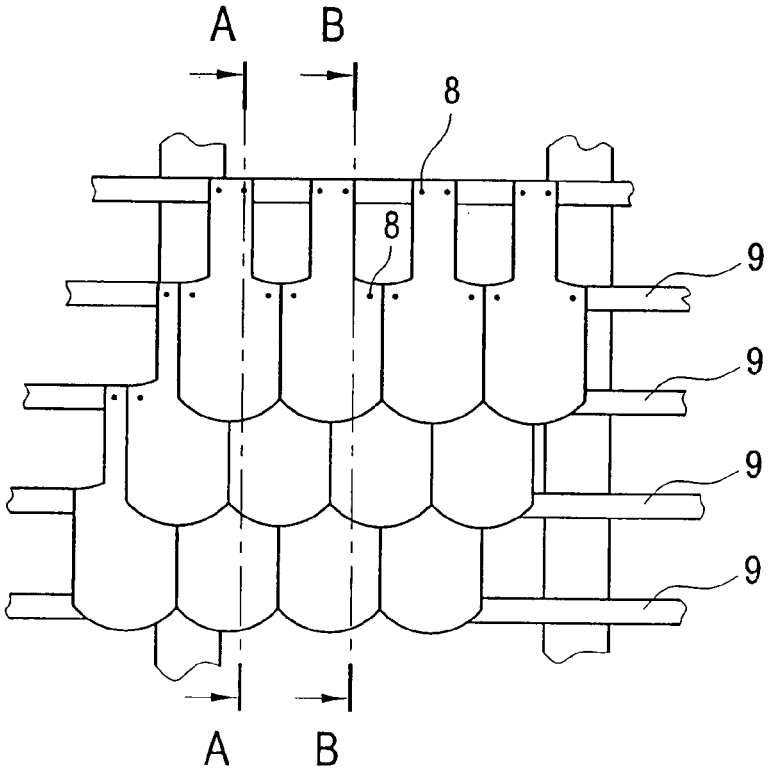
FIG. 2 shows an arrangement of three rows of placed shingles.
Figure 3:
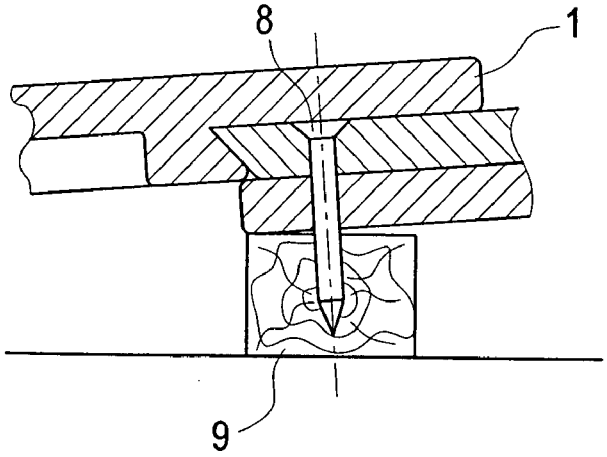
FIG. 3 shows a sectional view of a shingle placed on the roof.
Figure 4:
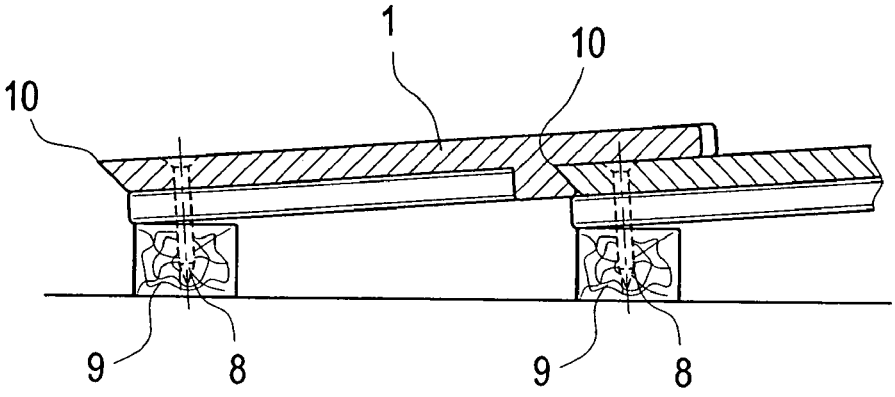
FIG. 4 shows a sectional view of a shingle attached to the rafters.
Figure 5:
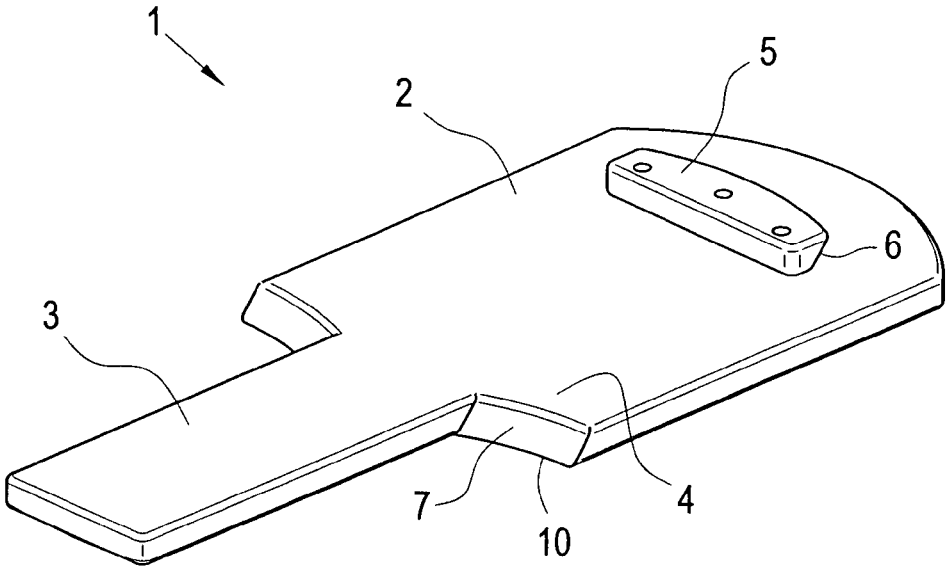
FIG. 5 shows a perspective view of a bottom side of the shingle.
Figure 6:
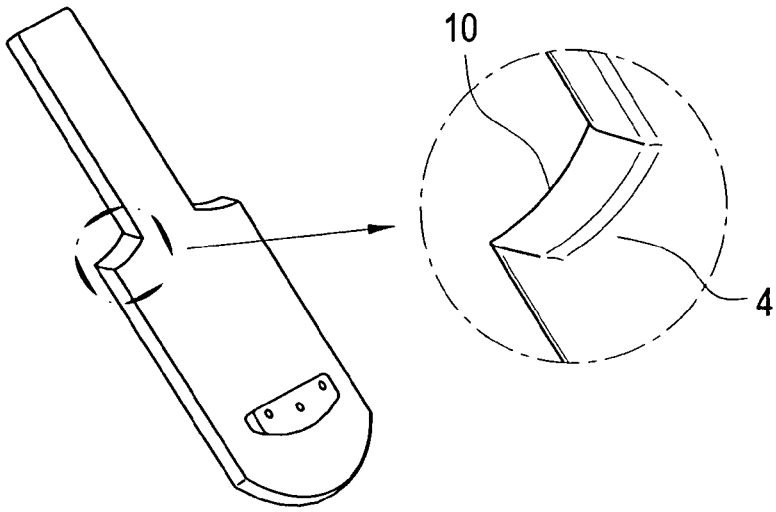
FIG. 6 is a perspective detail view of the shoulder of the shingle.

The roof is laid from the bottom to the top during the placement work in such a way as this is shown in detail in FIGS. 2, 3 and 4.

FIG. 2 shows the placement of the invention shingles under employment of attachment members, wherein the attachment members are designated with the reference numeral 8 and wherein the attachment elements are for example nails and/or rivets.

The shoulder 4 of the shingle exhibits an outer edge 10 which is sharp as a knife and which is shown in FIG. 4.

The in principle known rafters are designated with the reference numeral 9. A cross-section through the representation of FIG. 2 is shown in FIG. 3. A detail of the representation of FIGS. 2 and 3 is illustrated in FIG. 4.

The shingle according to the present invention can be subdivided in half or also in three parts in particular for forming the edge zones of roofs, wherein the half elements or third elements are part of the general present invention principle.

It will be understood that each of the elements described above, or two or more together, may also find a useful application in other types of roofing system configurations and shingle laying procedures differing from the types described above.

While the invention has been illustrated and described as embodied in the context of a shingle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

The invention claimed is:

1. A shingle comprising a shingle neck;

a shingle body;

a first shingle shoulder disposed on a first side between the shingle neck and the shingle body;

a first male undercut zone projecting on a top side of the first shoulder;

a second shingle shoulder (4) disposed on a second side between the shingle neck and the shingle body;

a second male undercut zone projecting on a top side of the second shoulder;

a raised engagement and guide element disposed on an inner side of the shingle body and in a lower region of the shingle body and disposed remote from the shingle neck forming a female mold undercut zone (6) and wherein the first male undercut zone matches the shape of the part of the raised engagement and guide element on the second side for engaging the first male undercut zone with a part of another raised engagement and guide element on another second side of a second shingle constructed like the first shingle and wherein the second male undercut zone matches the shape of the part of the raised engagement and guide element on the first side for engaging the second male undercut zone with a part of another raised engagement and guide element on another first side of a third shingle constructed like the first shingle;

wherein the raised engagement and guide element (5) is disposed in the lower region of the shingle body (2), wherein the raised engagement and guide element (5) defines a female mold undercut zone (6) open on a downward side and extending horizontally along the shingle body and having a deepest point adjacent to the shingle body.

2. The shingle according to claim 1, wherein the shingle neck and the shingle body are disposed in one plane, and wherein the raised engagement and guide element projects from the shingle body by a height level corresponding to a thickness of the shingle body.

3. The shingle according to claim 1, wherein a horizontal extension of the first shingle shoulder (4) corresponds to about one half of a horizontal extension of the raised engagement and guide element (5); and wherein a horizontal extension of the second shingle shoulder (4) corresponds to about one half of a horizontal extension of the raised engagement and guide element (5).

4. The shingle according to claim 1, wherein the shingle is a roof shingle.

5. The shingle according to claim 1, wherein the shingle is a house shingle.

6. The shingle according to claim 1 wherein the raised engagement and guide element has a shape of a horizontally extending overhang.

7. The shingle according to claim 1, wherein the raised engagement and guide element is projecting from an inner side face of the shingle body.

8. The shingle according to claim 1, wherein an edge of the shingle body on the first side is straight and nearly vertical; and wherein an edge of the shingle body on the second side is straight and disposed substantially parallel to the edge of the shingle body on the first side; and wherein the raised engagement and guide element is disposed in a middle between the edge of the shingle body on the first side and the edge of the shingle body on the second side.

9. The shingle according to claim 8, wherein a first edge on the first side of the neck of the shingle is disposed straight and parallel to the edge of the shingle body on the first side;

wherein a second edge on the second side of the neck of the shingle is disposed straight and parallel to the edge of the shingle body on the second side;

wherein the edge of the shingle body on the first side is longer than the first edge on the first side of the neck of the shingle; and wherein the edge of the shingle body on the second side is longer than the second edge on the second side of the neck of the shingle.

10. The shingle according to claim 1, wherein the neck of the shingle and the body of the shingle are located in one geometric plane.

11. The shingle according to claim 1 wherein the engagement and guide element is formed as a projection from the body of the shingle, wherein an end face of the engagement and guide element forms a plane disposed parallel to a plane of the body of the shingle; and wherein the projection extends at an angle from the body of the shingle; wherein an angle of the first male mold undercut zone (7) relative to the plane of the body of the shingle matches the angle of the projection; and wherein an angle of the second male mold undercut zone (7) relative to the plane of the body of the shingle matches the angle of the projection.

12. A shingle comprising a shingle neck;

a shingle body;

a first shingle shoulder disposed on a first side between the shingle neck and the shingle body;

a first male undercut zone projecting on a top side of the first shoulder;

a second shingle shoulder (4) disposed on a second side between the shingle neck and the shingle body;

a second male undercut zone projecting on a top side of the second shoulder;

a raised engagement and guide element disposed on an inner side of the shingle body and in a lower region of the shingle body and disposed remote from the shingle neck forming a female mold undercut zone (6) and wherein the first male undercut zone matches the shape of the part of the raised engagement and guide element on the second side for engaging the first male undercut zone with a part of another raised engagement and guide element on another second side of a second shingle constructed like the first shingle and wherein the second male undercut zone matches the shape of the part of the raised engagement and guide element on the first side for engaging the second male undercut zone with a part of another raised engagement and guide element on another first side of a third shingle constructed like the first shingle;

wherein the first male undercut zone has an edge disposed in a plane of an outside of the shingle;

wherein the second male undercut zone has an edge disposed in a plane of an outside of the shingle; and wherein the raised engagement and guide element has a deepest bottom groove adjacent to a plane on the inner surface of the shingle body.

13. The shingle according to claim 12, wherein the raised engagement and guide element (5) is disposed in the lower region of the shingle body (2), wherein the raised engagement and guide element (5) defines a female mold undercut zone (6) open on a downward side and extending horizontally along the shingle body and having a deepest point adjacent to the shingle body.

14. A shingle comprising a shingle neck;

a shingle body;

a first shingle shoulder disposed on a first side between the shingle neck and the shingle body;

a first male undercut zone projecting on a top side of the first shoulder;

a second shingle shoulder (4) disposed on a second side between the shingle neck and the shingle body;

a second male undercut zone projecting on a top side of the second shoulder;

a raised engagement and guide element disposed on an inner side of the shingle body and in a lower region of the shingle body and disposed remote from the shingle neck forming a female mold undercut zone (6) and wherein the first male undercut zone matches the shape of the part of the raised engagement and guide element on the second side for engaging the first male undercut zone with a part of another raised engagement and guide element on another second side of a second shingle constructed like the first shingle and wherein the second male undercut zone matches the shape of the part of the raised engagement and guide element on the first side for engaging the second male undercut zone with a part of another raised engagement and guide element on another first side of a third shingle constructed like the first shingle;

wherein a depth of the projection of the raised engagement and guide element is substantially equal to a thickness of the shingle body.

15. The shingle according to claim 14, wherein the raised engagement and guide element (5) is disposed in the lower region of the shingle body (2), wherein the raised engagement and guide element (5) defines a female mold undercut zone (6) open on a downward side and extending horizontally along the shingle body and having a deepest point adjacent to the shingle body.

16. The shingle according to claim 14, wherein the first male undercut zone has an edge disposed in a plane of an outside of the shingle;

wherein the second male undercut zone has an edge disposed in a plane of an outside of the shingle; and wherein the raised engagement and guide element has a deepest bottom groove adjacent to a plane on the inner surface of the shingle body.

17. A shingle consisting of:

a shingle neck;

a shingle body;

a first shingle shoulder disposed on a first side between the shingle neck and the shingle body;

a first male undercut zone projecting on a top side of the first shoulder;

a second shingle shoulder (4) disposed on a second side between the shingle neck and the shingle body;

a second male undercut zone projecting on a top side of the second shoulder;

a raised engagement and guide element disposed on an inner side of the shingle body and in a lower region of the shingle body and disposed remote from the shingle neck forming a female mold undercut zone (6) and wherein the first male undercut zone matches the shape of the part of the raised engagement and guide element on the second side for engaging the first male undercut zone with a part of another raised engagement and guide element on another second side of a second shingle constructed like the first shingle and wherein the second male undercut zone matches the shape of the part of the raised engagement and guide element on the first side for engaging the second male undercut zone with a part of another raised engagement and guide element on another first side of a third shingle constructed like the first shingle.

18. A shingle comprising a shingle neck;

a shingle body;

a first shingle shoulder disposed on a first side between the shingle neck and the shingle body;

a first male undercut zone projecting on a top side of the first shoulder;

a second shingle shoulder (4) disposed on a second side between the shingle neck and the shingle body;

a second male undercut zone projecting on a top side of the second shoulder;

a raised engagement and guide element disposed on an inner side of the shingle body and in a lower region of the shingle body and disposed remote from the shingle neck forming a female mold undercut zone (6) and wherein the first male undercut zone matches the shape of the part of the raised engagement and guide element on the second side for engaging the first male undercut zone with a part of another raised engagement and guide element on another second side of a second shingle constructed like the first shingle and wherein the second male undercut zone matches the shape of the part of the raised engagement and guide element on the first side for engaging the second male undercut zone with a part of another raised engagement and guide element on another first side of a third shingle constructed like the first shingle;

wherein the inner side of the shingle defines a first plane;

wherein an outer side of the shingle defines a second plane disposed parallel to the first plane;

wherein the shingle neck defines an axial direction;

wherein a plurality of sectional planes is disposed perpendicular to the first plane and contain a straight line disposed parallel to the axial direction of the neck;

wherein the first male undercut zone is formed by a first ridge;

wherein the first ridge forms a first acute angle with the second plane when intersected by one of the plurality of sectional planes;

wherein the first ridge forms a first obtuse angle with the first plane when intersected by one of the plurality of sectional planes;

wherein the second male undercut zone is formed by a second ridge;

wherein the second ridge forms a second acute angle with the second plane when intersected by one of the plurality of sectional planes;

wherein the second ridge forms a second obtuse angle with the first plane when intersected by one of the plurality of sectional planes.

19. The shingle according to claim 18, wherein an inner side of the raised engagement and guide element defines a third plane disposed parallel to the first plane;

wherein the female mold undercut zone is formed by a ledge;

wherein the ledge forms a third acute angle with the third plane when intersected by one of the plurality of sectional planes;

wherein the ledge forms a third obtuse angle with the first plane when intersected by one of the plurality of sectional planes.

20. The shingle according to claim 19, wherein the first acute angle is from about 40 to 50 degrees;

wherein the second acute angle is from about 40 to 50 degrees;

wherein the third acute angle is from about 40 to 50 degrees;

wherein the first obtuse angle is from about 130 to 140 degrees;

wherein the second obtuse angle is from about 130 to 140 degrees;

wherein the third obtuse angle is from about 130 to 140 degrees.

21. The shingle body according to claim 18 wherein a depth of the projection of the raised engagement and guide element is substantially equal to a thickness of the shingle body.

22. A shingle comprising a shingle neck having an axial direction;

a shingle body;

a first shingle shoulder disposed on a first side between the shingle neck and the shingle body;

a first ridge forming a top side of the first shoulder;

a second shingle shoulder disposed on a second side between the shingle neck and the shingle body;

a second ridge forming a top side of the second shoulder;

a raised engagement and guide element disposed on an inner side of the shingle body and in a lower region of the shingle body and disposed remote from the shingle neck forming a ledge (6);

wherein the inner side of the shingle defines a first plane;

wherein an outer side of the shingle defines a second plane disposed parallel to the first plane;

wherein the shingle neck defines an axial direction;

wherein a plurality of sectional planes is disposed perpendicular to the first plane and contain a straight line disposed parallel to the axial direction of the neck;

wherein an inner side of the raised engagement and guide element defines a third plane disposed parallel to the first plane;

wherein the ledge forms a third acute angle with the third plane when intersected by one of the plurality of sectional planes;

wherein the ledge forms a third obtuse angle with the first plane when intersected by one of the plurality of sectional planes.

23. The shingle according to claim 22, wherein the first ridge forms a first acute angle with the second plane when intersected by one of the plurality of sectional planes;

wherein the first ridge forms a first obtuse angle with the first plane when intersected by one of the plurality of sectional planes;

wherein the second ridge forms a second acute angle with the second plane when intersected by one of the plurality of sectional planes;

wherein the second ridge forms a second obtuse angle with the first plane when intersected by one of the plurality of sectional planes.

24. The shingle according to claim 23, wherein the first acute angle is from about 40 to 50 degrees;

wherein the second acute angle is from about 40 to 50 degrees;

wherein the third acute angle is from about 40 to 50 degrees;

wherein the first obtuse angle is from about 130 to 140 degrees;

wherein the second obtuse angle is from about 130 to 140 degrees;

wherein the third obtuse angle is from about 130 to 140 degrees.

* * * * *